United States Patent [19]

Vinson

[11] Patent Number: 4,964,747

[45] Date of Patent: Oct. 23, 1990

[54] CONCRETE FORM BRACKET

[76] Inventor: Michael A. Vinson, Rte. 1, Box 183, Milsap, Tex. 76066

[21] Appl. No.: 462,744

[22] Filed: Jan. 9, 1990

[51] Int. Cl.[5] ..... F16B 1/00; F16D 1/00

[52] U.S. Cl. ..... 403/24; 403/168; 256/37

[58] Field of Search ..... 403/167, 168, 409.1, 403/24; 411/535, 536, 538; 254/29 A; 256/37

[56] References Cited

U.S. PATENT DOCUMENTS

| | | | |
|---|---|---|---|
| 680,438 | 8/1901 | Pierce | 256/37 |
| 1,732,259 | 10/1929 | Colt | 254/29 A |
| 1,751,823 | 3/1930 | Lampert | 254/29 A |
| 3,285,568 | 11/1966 | Biach | 254/29 A |

*Primary Examiner*—Andrew V. Kundrat
*Attorney, Agent, or Firm*—James E. Bradley

[57] ABSTRACT

A bracket for a wall form tightens ties used to secure the wall forms together. The bracket has a cam assembly with an inner member and an outer member axially aligned with each other. The inner and outer members have tapered abutting wedge surfaces. The outer member has a lug for receiving an end of the tie. A key may be inserted into one of the members to rotate it. Rotating one of themembers relative to the other causes the lug to move outward to tighten the tie, or to move inward to release the bracket from the tie.

9 Claims, 1 Drawing Sheet

CONCRETE FORM BRACKET

BACKGROUND OF THE INVENTION

1. Field of the Invention

This invention relates in general to forming equipment for forming concrete walls, and in particular to a device which will tighten ties or rods extending through the form panels to hold them together.

2. Description of the Prior Art

One technique for building a concrete wall uses vertical forms. The form will have two spaced apart form panels. The form panels have a number of holes in them. Ties, which are stiff wires or rods, extend through the holes and connect the two panels together to hold them in place. Horizontal braces, called "walers", extend horizontally along the form panels to provide strength.

The ends of the ties protrude out from the holes and are fastened by various fasteners. Tightening the ends of the ties is time consuming and often requires more than one person. A hammer is often used for tightening and loosening the fasteners. Damage to the fasteners may occur. Also, often while pouring, some of the concrete may drop onto the fasteners. This makes them difficult to loosen.

SUMMARY OF THE INVENTION

In this invention, a fastening bracket with a cam is provided. It has an inner member or cam and an outer member or cam follower. The inner member and the outer member have tapered abutting wedge surfaces. A lug is on the outer member for receiving the end of the tie. One of the members will rotate relative to the other member. A key will insert into the member to cause this rotation. When this rotation occurs, the tapered surfaces slide on each other. This causes the lug to move inward and outward to loosen and tighten the tie.

DESCRIPTION OF THE PREFERRED EMBODIMENT

Figure 1:
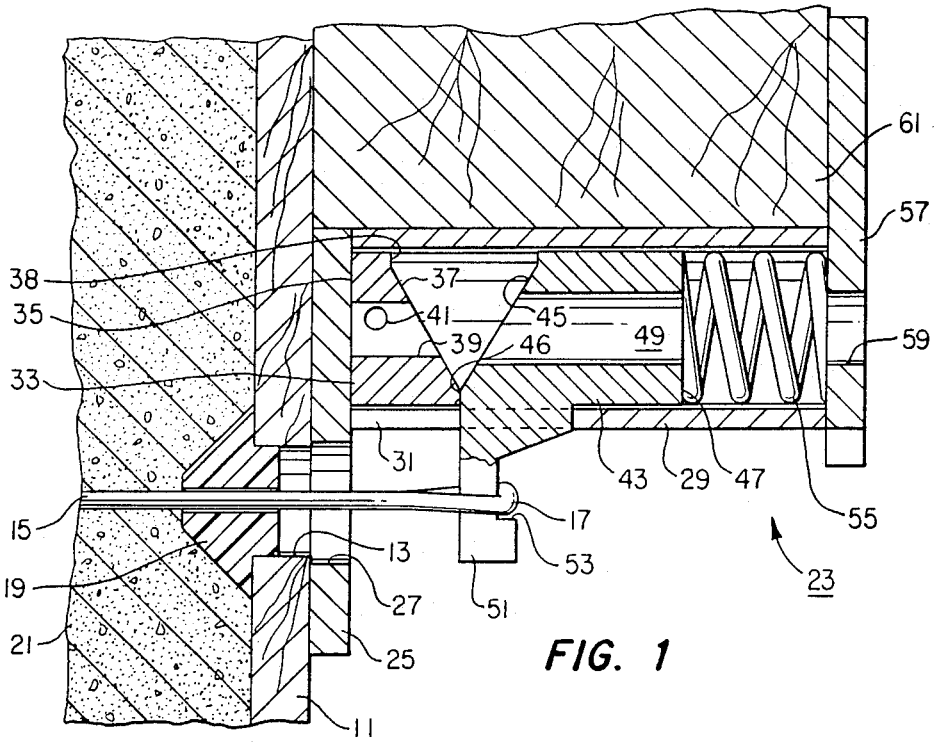
FIG. 1 is a vertical sectional view illustrating a bracket constructed in accordance with this invention, shown in a tightened position.

Referring to the figures, the concrete form will have a form panel 11. Panel 11 is a sheet of plywood or the like that will stand vertically. It will be spaced from another form panel (not shown) to serve as the inner and outer forms for a concrete wall. The form panel has a plurality of holes 13 spaced along at various points. A plurality of ties 15 (only one shown) extend between the two form panels 11. Each tie 15 has a loop 17 on its outer end that extends out through one of the holes 13. The loop comprises a folded over end portion of tie rod 15, joined to the remaining portion of tie rod 15 to define an aperture. A grommet 19, normally an elastomer, will seal around the hole 13 and center the tie 15 in the hole 13. Concrete 21 will be poured between the two form panels 11 after the ties 15 are tightened.

A bracket 23 is used to tighten each loop 17 of the tie 15. Bracket 23 has a bearing plate 25. The bearing plate 25 abuts against the exterior of the form panel 11. Bearing plate 25 has a hole 27 extending through it which aligns with one of the holes 13 in the form panel 11.

A barrel 29 will be welded to the bearing plate 25. Barrel 29 extends outward from the bearing plate 25. Barrel 29 has an axis that is parallel to the axis of the tie 15. Barrel 29 will be located above the hole 27. Barrel 29 is cylindrical and hollow. It has a slot 31 which is formed in the lower side and which extends back slightly less than half its length. Slot 31 is thin and elongated.

Barrel 29 contains a cam 33 within it. Cam 33 has a cylindrical exterior and will rotate inside the barrel 29. Cam 33 has an inner end 35 that abuts the bearing plate 25. The inner end 35 is perpendicular to the axis of the barrel 29. Cam 33 has an outer end 37 that is wedge shaped or tapered. It inclines at about a 30 degree angle relative to the axis of barrel 29. A rim 38 encircles the outer end 37. Rim 38 is in a plane perpendicular to the axis of the cam 33. A polygonal hole 39 extends through the cam 33. Hole 39 may be square or it may have more sides than four. A small depression 41 is formed inside the polygonal hole 33.

Figure 2:
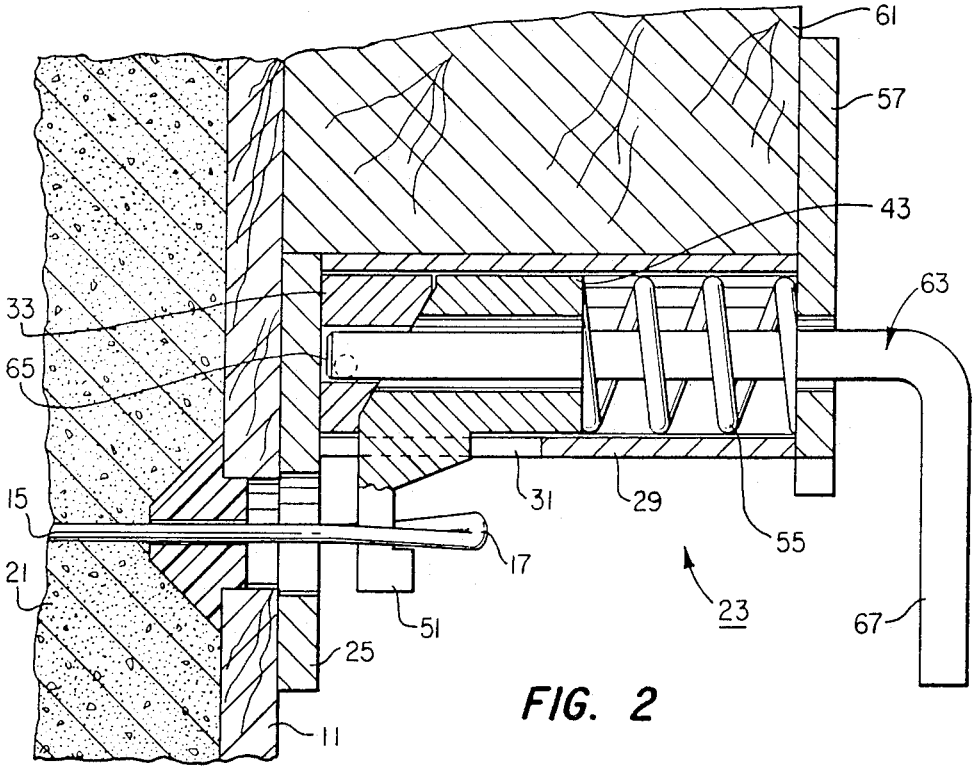
FIG. 2 is a vertical cross sectional view of the bracket of FIG. 1, shown in a loosened position.

A cam follower 43 is also located inside the barrel 29. Cam follower 43 has a cylindrical exterior, but it is not rotatable within the barrel 29. Cam follower 43, however, is axially slidable in the barrel 29 to a certain extent. Cam follower 43 has an inner end 45 that is inclined. The inclination of the inner end 45 is the same as the inclination of the outer end 37 of the cam 33. A circular rim 46 extends around the periphery of the inner end 45. Rim 46 is located in a plane perpendicular to the axis of the barrel 29. Rim 46 abuts a portion of rim 38 when in the tightened position shown in FIG. 1. In the tightened position, the tapered portions of the ends 37, 45 do not engage each other. In the loosened position shown in FIG. 2, the tapered portions of the ends 37, 45 engage each other and the rims'38, 46 fully engage each other.

Cam follower 43 has an outer end 47 that the perpendicular to the axis of the barrel 29. A passage 49 extends through the cam follower 43. Passage 49 is cylindrical. It has a diameter greater than the cross-sectional dimensions of the polygonal hole 39 in the cam 33. A lug 51 extends downward from the lower side of the cam follower 43. Lug 51 extends through the slot 31 to a point in alignment with the tie 15. Lug 51 has a flange 53 on its end where the loop 17 can be brought over the lug 51. Flange 53, which is located on the outer side of the lug 51, retains the tie loop 17.

A coil spring 55 is located inside the barrel 29. Coil spring 55 has its inner end in abutment with the cam follower 43. The outer end of coil spring 55 abuts an end plate 57. End plate 57 is a vertical plate parallel to the bearing plate 25. End plate 57 has a hole 59 in it that is aligned with the hole 39 in passage 49. End plate 57 extends upward from the barrel 29 a selected distance. A waler or horizontal brace 61 will be positioned between the end plate 57 and the form panel 11. The lower sides of the waler 61 will lie on top of the upper side of the barrel 29.

The apparatus also includes a key 63. Key 63 has an inner end 65 that inserts through the holes 59, 49 and into the polygonal hole 39. A small ball or detent (not shown) on the inner end 65 will snap into the depression 41. Key 63 has an L shape to it. A handle portion 67 will be located on the exterior of the end plate 57. The handle can be grasped by a user and rotated.

In operation, the form panels 11 will be assembled with tie 15 extending between them. A bracket 23 will be placed adjacent to each tie loop 17. The key 63 will be inserted into the outer end 37 to rotate the cam 33 so that the cam follower 43 will spring to the inner position shown in FIG. 2. The lug 51 will be inserted into the loop 17. A waler 61 will be placed on top of the barrel 29. The user grasps the handle 67 and rotates it. This causes the cam 33 to rotate relative to the cam follower 43 and barrel 29. The inclined surfaces 37, 45 force the cam follower 43 outward. The lug 51 moves outward, pulling the tie 15 tight. Spring 55 will further compress. The tie loop 17 on the opposite end (not shown) will be tightened at the same time and in the same manner.

Concrete 21 will be poured once all of the brackets 23 are installed. After hardening, the brackets 23 are removed. This is done by inserting the key 63 and rotating the cam 33 to the position shown in FIG. 2. The lug 51 will be located inward enough so that the bracket 23 and waler 61 can be removed. Subsequently, the form panel 11 is also removed. The grommet 19 will remain with the hardened concrete 21, as well as the tie 15. The loop 17 may be cut off flush with the end of the grommet 19.

The invention has significant advantages. The brackets are easy and quick to install. The moving parts are enclosed from weather and concrete spillage The parts can be lubricated for ease of functioning. Hammering or cheater pipes are not needed to tighten the bracket. The key is removed after use, so that it can't be hit, accidentally releasing the bracket. Only one worker is required for installing the brackets. It does not have to be nailed into position to lock. It will work with horizontal or vertical walers, above or below, or to the right or to the left.

While the invention has been shown in only one of its forms, it should be apparent to those skilled in the art that it is not so limited but is susceptible to various changes without departing from the scope of the invention.

I claim:

1. In a wall form for forming a concrete wall, the wall form being of a type having spaced apart form panels with a plurality of holes, a tie extending through each of the holes to retain the form panels in position, an improved apparatus for tightening the ties, comprising in combination:

a cam assembly having an inner member and an outer member axially aligned with the inner member, the cam assembly adapted to bear against one of the panels;

tapered abutting wedge surfaces on the inner and outer members;

a lug on the outer member for receiving an end of the tie and movable linearly therewith; and rotating means for rotating one of the members relative to the other member to cause one of the wedge surfaces to rotate relative to the other wedge surface, for moving the lug from an inner position to an outer position to tighten the tie.

2. The apparatus according to claim 1 wherein the rotating means rotates the inner member.

3. The apparatus according to claim 1 wherein the rotating means comprises an axial polygonal hole formed in the outer end of the inner member and a key adapted to insert into the hole.

4. In a wall form for forming a concrete wall of a type having a form panel with a plurality of holes, a tie extending through each of the holes to retain the form panel in position, an improved apparatus for tightening the tie, comprising in combination:

a bearing plate having an aperture and adapted to be positioned against the form panel with the aperture aligned with one of the holes;

a cam assembly having an inner member and an outer member, each of the inner and outer members having inner and outer ends, the inner end of the inner member being in abutting contact with the bearing plate;

an inclined wedge surface on the outer end of the inner member and on the inner end of the outer member, the wedge surfaces abutting each other;

a lug on the outer member and positioned in alignment with the aperture in the plate for receiving an end of the tie;

rotating means for rotating one of the members relative to the other member to cause one of the wedge surfaces to rotate relative to the other wedge surface, for moving the lug from an inner position to an outer position relative to the panel, to tighten the tie; and spring means for urging the outer member inward against the inner member.

5. The apparatus according to claim 4 wherein the rotating means comprises a polygonal hole located in the outer end of one of the members, and a key adapted to be inserted into the polygonal hole.

6. The apparatus according to claim 4 wherein the rotating means comprises a polygonal hole located in the outer end of the inner member, the outer member having an axial passage axially aligned with and larger in diameter than the cross-sectional dimension of the polygonal hole, and a key adapted to extend through the passage into the polygonal hole for rotating the inner member.

7. The apparatus according to claim 4 wherein a plurality of horizontal braces are located on the exterior of the form panel and wherein the apparatus further comprises an end plate positioned outward of the outer member and extending upward for receiving one of the horizontal braces between the end plate and the form panel.

8. In a wall form for forming a concrete wall of a type having a form panel with a plurality of holes, a tie extending through each of the holes to retain the form panel in position, and a plurality of horizontal braces located on the exterior of the panel, an improved apparatus for tightening the tie, comprising in combination:

a bearing plate having an aperture and adapted to be positioned against the form panel with the aperture aligned with one of the holes;

a tubular barrel having an inner end secured to the bearing plate above the aperture and an outer end extending outward parallel to the axis of the tie;

an elongated slot formed in the barrel above the aperture in the bearing plate and extending a selected distance along the length of the barrel;

an end plate mounted to the outer end of the barrel and extending upward for receiving a horizontal brace between the end plate and the form panel;

a cam rotatably carried inside the barrel, the cam having an inner end that abuts the bearing plate and is perpendicular to the axis of the barrel, the cam having an outer end that inclines transverse to the axis of the barrel;

an axial polygonal hole formed in the outer end of the cam;

a cam follower carried in the barrel for axial sliding movement relative to the barrel, the cam follower having an inner end that engages the outer end of the cam and which inclines transverse to the axis of the barrel at the same inclination as the outer end of the cam;

a passage extending axially through the cam follower in axial alignment with the polygonal hole, the passage being of greater diameter than the cross-sectional dimension of the polygonal hole;

a lug on the cam follower, extending downward through the slot in alignment with the aperture in the plate for receiving an end of the tie;

a spring compressed in the barrel between the outer end of the cam follower and the end plate for urging the cam follower inward;

a hole located in the end plate in axial alignment with the passage in the cam follower; and a key adapted to be inserted through the hole in the end plate, the passage in the cam follower and into the polygonal hole in the cam for rotating the cam relative to the cam follower to cause the cam follower and the lug to selectively move outward and inward for tightening the tie and for selectively removing the apparatus.

9. The apparatus according to claim 8 wherein the tie has a lug on its end, and wherein the lug has a flange for retaining the loop.

* * * * *